US005460133A

United States Patent [19]

Perr et al.

[11] Patent Number: 5,460,133

[45] Date of Patent: Oct. 24, 1995

[54] SOLENOID OPERATED PUMP-LINE-NOZZLE FUEL INJECTION SYSTEM AND INLINE PUMP THEREFOR

[75] Inventors: J. P. Perr; L. L. Peters; L. D. Tikk; Y. J. Tarr, all of Columbus, Ind.

[73] Assignee: Cummins Engine Company, Inc., Columbus, Ind.

[21] Appl. No.: 325,528

[22] Filed: Oct. 19, 1994

Related U.S. Application Data

[63] Continuation-in-part of Ser. No. 102,830, Aug. 6, 1993, Pat. No. 5,377,636.

[51] Int. Cl.[6] ..... F02M 37/04; F02M 7/00

[52] U.S. Cl. ..... 123/446; 123/501

[58] Field of Search ..... 123/446, 500, 123/502, 506, 501

[56] References Cited

U.S. PATENT DOCUMENTS

| | | | |
|---|---|---|---|
| 2,947,257 | 8/1960 | Bessiere . | |
| 2,950,709 | 8/1960 | Bessiere . | |
| 3,035,523 | 2/1962 | Kemp et al. . | |
| 4,502,445 | 3/1985 | Roca-Nierga et al. | 123/458 |
| 4,531,672 | 7/1985 | Smith | 239/89 |
| 4,621,605 | 11/1986 | Carey, Jr. et al. | 123/446 |
| 4,971,016 | 11/1990 | Peters et al. | 123/446 |
| 5,040,511 | 8/1991 | Eckert | 123/501 |
| 5,042,445 | 8/1991 | Peters et al. | 123/446 |

FOREIGN PATENT DOCUMENTS

| | | |
|---|---|---|
| 442839 | 5/1934 | United Kingdom . |
| 1306422 | 2/1973 | United Kingdom . |

OTHER PUBLICATIONS

SAE Publication No. SP–703, Recent Developments in Electronic Engine Control & Fuel Injection Management, paper Nos. 870433, 870434 and 870436, pp. 37–42, 43–51 and 65–77, published Feb., 1987.

*Primary Examiner*—Thomas N. Moulis

*Attorney, Agent, or Firm*—Sixbey, Friedman, Leedom & Ferguson; David S. Safran

[57] ABSTRACT

A pump-line-nozzle fuel injection system in which a low pressure supply pump is coupled to a high pressure in-line pump having a plurality of pumping cylinders, each of which has a cam-driven timing plunger and a floating metering plunger. During the retraction stroke, flow to a timing chamber formed between the pistons is controlled by a first solenoid valve while the fuel flow into a metering chamber is controlled by a second solenoid valve. During metering, the discharge side of the pump is closed relative to a high pressure delivery line by a delivery valve. During the compression stroke, return flow is precluded by check valves in the supply lines to the timing and metering cylinders. Most importantly, since only one pumping cylinder of each pumping group undergoes its metering and injection phases at a given time, the timing and metering plungers of the other pumping cylinders being held in their maximally inwardly displaced, end-of-injection positions at that time, a single set of timing and metering solenoid valves can be used to individually meter fuel into the metering chamber and timing fluid into the timing chamber, independently and with the quantities metered being infinitely adjustable on a individual cylinder and cycle-to-cycle basis. Once the fuel is sufficiently pressurized, the delivery valve opens and the fuel is delivered to the respective injector via the high pressure delivery line from the particular one of the pumping cylinders.

12 Claims, 8 Drawing Sheets

SOLENOID OPERATED PUMP-LINE-NOZZLE FUEL INJECTION SYSTEM AND INLINE PUMP THEREFOR

CROSS-REFERENCE TO RELATED APPLICATION

This application is a continuation-in-part of commonly owned U.S. patent application Ser. No. 08/102,830, filed Aug. 6, 1993, now U.S. Pat. No. 5,377,636.

BACKGROUND OF THE INVENTION

1. Field of the Invention

The present invention relates to solenoid operated pump-line-nozzle fuel injections systems for internal combustion engines. In particular, to such fuel injection systems in which an inline injection pump utilizes a solenoid-operated control for regulating injection timing and the quantity of fuel injected.

2. Description Of Related Art

Inline injection pumps and pump-line-nozzle fuel injections systems using such pumps are old and well known. A discussion of several examples of such pumps and systems, and the efforts taken to improve their construction so that the increasing demands for low exhaust emissions can be met, can be found, for example, in SAE publication no. SP-703, *Recent Developments in Electronic Engine Control & Fuel Injection Management*, paper nos. 870433, 870434 and 870436, pages 37–42, 43–51 & 65–77 published February, 1987. Inline pumps have a separate pumping cylinder for supplying fuel to each injection nozzle of the injection system, to which it is connected by a fuel line (hence, the name pump-line-nozzle injection system), a respective injection nozzle being provided for each engine cylinder. While inline pumps, such as those described in the papers cited above, are able to independently control injection timing and injection quantity, none of the known inline pumps produces individual cylinder control of both timing and fuel quantity on an infinitely adjustable basis; that is, typically such pumps having a control rack which adjusts all pumping cylinders in the same manner at the same time, and frequently using a step-wise adjusting driver.

Another type of pump used in pump-line-nozzle systems is a distributor pump. Examples of such pumps can be found in U.K. Patent Nos. 442,839 and 1,306,422 as well as U.S. Pat. Nos. 3,035,523 and 4,502,445, and a system and component description of both inline and distributor pumps can be found at page 24 of the above-cited SAE publication SP-703 in paper no. 870432 as well. In distributor pumps, only a single pumping cylinder is provided and a rotary distributor determines which injection nozzle will receive a specific dose of fuel. Inherently, such pumps cannot provide individual cylinder control since they lack individual pumping cylinders to control; however, as indicated, e.g., in U.S. Pat. Nos. 2,947,257 and 2,950,709, such distributor pumps can be constructed as multicylinder pumps as well (but in such a case they essentially become inline pumps, with a rack, cam or other single regulating mechanism being used to control "the whole of the injectors" and to insure that fuel delivery "is the same for all the cylinders"), so that individual cylinder control is still not obtained.

Another type of fuel injection system, which is fundamentally different from pump-line-nozzle systems, is the unit injector fuel injection system. In such a system, a positive displacement pump is used to supply fuel at low pressure, typically at constant pressure of e.g., 30 psi, to a respective unit fuel injector associated with each engine cylinder. The unit injectors, themselves, regulate the timing and metering of the fuel into the respective engine cylinder and also develop the high pressure, e.g., at least 15,000 psi at which the fuel needs to be injected into the engine cycle if the requirements for increased fuel economy and decreased emissions are to be achieved.

Solenoid operated fuel injectors of the unit injector type having characteristics of the type sought to be obtained with the inline pump of the pump-line-nozzle injector system of the present invention have been in use for some time, and an example of such an injector can be found in commonly-owned U.S. Pat. No. 4,531,672 to Smith. In this type of injection, a timing chamber is defined between a pair of plungers that are reciprocatingly displaceable within the bore of the body of the injector and a metering chamber is formed in the bore below the lower of the two plungers. A supply rail in the engine delivers a low pressure supply of fuel to the injector body. To control this supply of fuel, a solenoid valve is disposed in the flow path between the fuel supply rail and the injector bore and the plungers block and unblock respective ports leading from injector body fuel supply circuit into the timing and metering chambers.

During the operation of such an injector, the port to the timing chamber is opened during retraction of the plungers to allow fuel to enter the timing chamber. During the injector downstroke, the timing port is closed by the upper plunger, and then, the metering port is opened to direct the supply of fuel into the metering chamber. During the entire time, from the start of the timing period through the end of the metering period, the solenoid valve remains open.

In an existing unit injector design, sold by the Cummins Engine Co. under the CELECT trademark, shown in FIGS. 1–3, improved performance is achieved. In this existing unit fuel injector 1, as shown in FIG. 1, initially, during the retraction stroke, with the solenoid valve 3 closed, the metering plunger 5 and the timing plunger 7 rise together, and fuel under rail pressure is metered into the metering chamber 9. When the proper quantity of fuel has been metered, the solenoid valve 3 is opened (FIG. 2), allowing fuel to flow into the timing chamber 11, causing the pressure at the top and bottom of the metering plunger to be equalized, thereby stopping movement of the metering plunger 5 while the timing plunger 7 continues to rise, and the timing chamber 11 to fill, as the retraction stroke is completed.

During the downstroke, prior to the time at which injection is to commence, as shown in FIG. 3, the solenoid valve 3 remains open and fuel is forced back out of the timing chamber 11, through the solenoid valve 3 into supply circuit. A relief valve assembly 15 is provided to vent high pressure spikes from the rail side of the injector 1 to the drain side thereof (enlarged detail of FIG. 3). More specifically, the relief valve assembly 15 comprises a valve member **15*a* which is urged against a relief port 15*b* by a coil spring 15*c* which is disposed in a barrel member 17, the upper surface of which forms the bottom wall of the metering chamber 5 and which contains channels through which fuel flows between the fuel inlet port and the metering chamber and from the metering chamber to a drain passage 21. When the pressure of the backflowing timing fluid exceeds that of spring 15*c*, the valve member 15*a* unblocks relief port 15*b*, thereby opening a path from the fuel supply circuit to drain passage 21. At the end of the injection phase, when the solenoid 3 is closed, the top edge of the metering plunger 5 passes below at least one timing fluid spill port 23, thereby evacuating the timing chamber 11 via the drain passage 21. Additionally, passages *5a* in the metering plunger 5 are brought into communication with at least one spill port 25** by which a small quantity of fuel is spilled to the fuel supply circuit. Then, the described cycle of events is repeated.

However, while unit fuel injector fuel injection systems are available by which the amount of fuel injected and timing of its injection can be independently and infinitely adjusted on a individual cylinder and cycle-to-cycle basis, using a relatively simple, single solenoid control for each injector, unit injectors, due to increased tasks associated therewith in comparison to the injection nozzle of a pump-line-nozzle injection system, is relatively large in comparison to the injection nozzle of pump-line-nozzle injection systems. As a result, the use of unit fuel injector systems has been confined to large, heavy duty engines since insufficient space exists in the engine valve area of smaller engines to accommodate unit fuel injectors. Thus, there still is a need for further improvements to pump-line-nozzle fuel injector systems of the type to which this invention is directed, in order to provide the degrees of precision control needed to meet the competing demands for both increased fuel economy and decreased engine exhaust emissions.

In another unit fuel injector system development of the assignee of the present application, which is disclosed by several of the present inventors with another inventor in co-pending U.S. patent application Ser. No. 08/208,365, a metering system for controlling the amount of fuel supplied to the combustion chambers of a multi-cylinder internal combustion engine comprises a fuel pump for supplying fuel at low pressure to a first and a second group of unit fuel injectors via first and second fuel supply paths, respectively. A first solenoid-operated fuel control valve, positioned in the first fuel supply path between the fuel pump and the first set of unit fuel injectors, controls the flow of fuel to the first set of unit fuel injectors while a second solenoid-operated fuel control valve, positioned in the second fuel supply path between the fuel pump and the second set of unit fuel injectors, controls the flow of fuel to the second set of unit fuel injectors. Only one injector from the first group and one injector from the second group of unit fuel injectors can be placed in a mode for receiving fuel from the fuel pump at any given time during the operation of the engine, thereby allowing the metering of each injector to be independently controlled over a greater time period. The system may also include a first solenoid-operated timing fluid control valve positioned in a first timing fluid supply path associated with the first group of unit fuel injectors and a second solenoid-operated timing fluid control valve positioned in a second timing fluid supply path associated with the second group of unit fuel injectors, wherein at any given time only one injector from the first group and one injector from the second group of injectors can be placed in a timing fluid receiving mode. The injectors are capable of being in the fuel receiving mode, establishing a metering period, and the timing receiving mode, establishing a timing period, at the same time to increase the amount of time available for metering both timing fluid and fuel. By grouping the various injectors based on the order of injection, so that the injectors from each group are placed in the injection mode in spaced periods throughout each cycle of the engine, e.g. injectors from other groups injecting in the period of time between each injection mode, the system can be designed to permit longer metering and timing periods.

The unit injectors may include an injector body having an injection orifice at one end and a cavity communicating with the orifice and containing inner and outer plunger sections arranged to form a variable volume metering chamber between the inner plunger and the orifice for receiving fuel during the metering period and a variable volume timing chamber between the inner and outer plungers for receiving timing fluid during the timing period. The solenoid-operated valves are moved between open and closed positions during the metering and timing periods to allow fuel and timing fluid, respectively, to flow to the metering and timing chambers thereby defining metering and timing events, respectively. The metering and timing events for each injector occur only between periodic, relatively quick injection strokes of the plungers thereby minimizing the operating response time requirements of the control valves. The fuel supply passage to the metering chamber of each injector contains a spring-loaded check valve for preventing the flow of fuel out of the metering chamber while also preventing combustion gases from entering the supply passage and disturbing the effective control of metering. The injectors may be either open or closed nozzle injectors. A pressure regulator maintains the pressure in the timing fluid and fuel supply paths at a substantially constant pressure. Also, flow control valves may be provided downstream of the fuel pump to provide a fixed flow rate independent of fuel pressures upstream and downstream of the flow control valves.

SUMMARY OF THE INVENTION

In view of the foregoing, it is an object of the present invention to provide an pump-line-nozzle fuel injector system in which an inline injection pump utilizes a solenoid-operated control for regulating injection timing and the quantity of fuel injected so as to enable the amount of fuel injected and timing of its injection to be independently and infinitely adjusted on a individual cylinder and cycle-to-cycle basis in a manner minimizing the number of solenoid valves required as well as the operating pressure and response time requirements for the solenoid valves.

In connection with the preceding object, it is a more specific object to adapt known unit fuel injector technology to the environment of pump-line-nozzle systems where the compressibility of the fuel has a significant effect due to the length of the line between the pump and the nozzle.

A still further object is to provide an inline pump in which a pair of solenoid valves control metering and timing for a group of pumping cylinders in accordance with time-pressure (TP) principles (the quantity metered being determined by the amount of time that the respective valve is open), the pumping cylinders being grouped based on the order of injection, so that only one pumping cylinder from each group is placed into an injection mode and a timing mode at any given time.

Yet another object of the present invention is to achieve the foregoing objects through the use of the cam profile of the operating cam used to drive timing and metering plungers of each pumping cylinder as the mechanism by which initiation of injection is controlled.

These and other objects are achieved in accordance with a preferred embodiment of the invention in which a low pressure supply pump is coupled to a high pressure pump having a plurality of pumping cylinders, each of which has a cam-driven timing plunger and a floating metering plunger. During the retraction stroke, flow to a timing chamber formed between the pistons is controlled by a first solenoid valve while the fuel flow into a metering chamber is controlled by a second solenoid valve. During metering, the discharge side of the pump is closed relative to a high pressure delivery line by a delivery valve. During the compression stroke, return flow is precluded by check valves in the supply lines to the timing and metering cylinders. Most importantly, since only one pumping cylinder of each pumping group undergoes its metering and injection phases at a given time, the timing and metering plungers of the other pumping cylinders being held in their maximally inwardly displaced, end-of-injection positions at that time, a single set of timing and metering solenoid valves can be used to individually meter fuel into the metering chamber and timing fluid into the timing chamber, independently and with the quantities metered being infinitely adjustable on a individual cylinder and cycle-to-cycle basis. Once the fuel is sufficiently pressurized, the delivery valve opens and the fuel is delivered to the respective injector via the high pressure delivery line from the particular one of the pumping cylinders.

These and further objects, features and advantages of the present invention will become apparent from the following description when taken in connection with the accompanying drawings which, for purposes of illustration only, show a preferred embodiment in accordance with the present invention.

DETAILED DESCRIPTION OF THE PREFERRED EMBODIMENT

Figure 1:
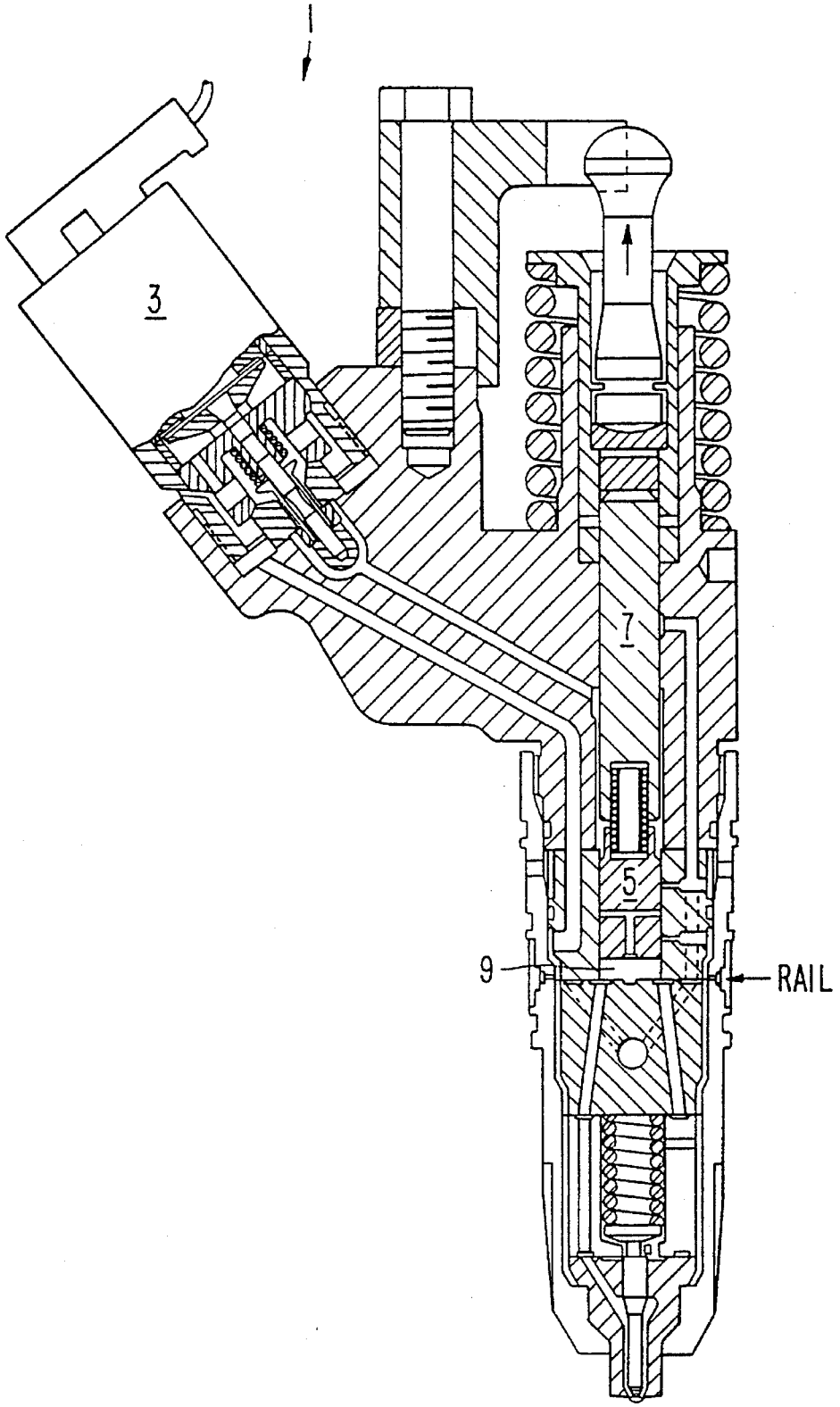
FIG. 1 (PRIOR ART)
FIG. 1 is schematic cross-sectional depiction of an existing unit fuel injector during a metering phase.
Figure 2:
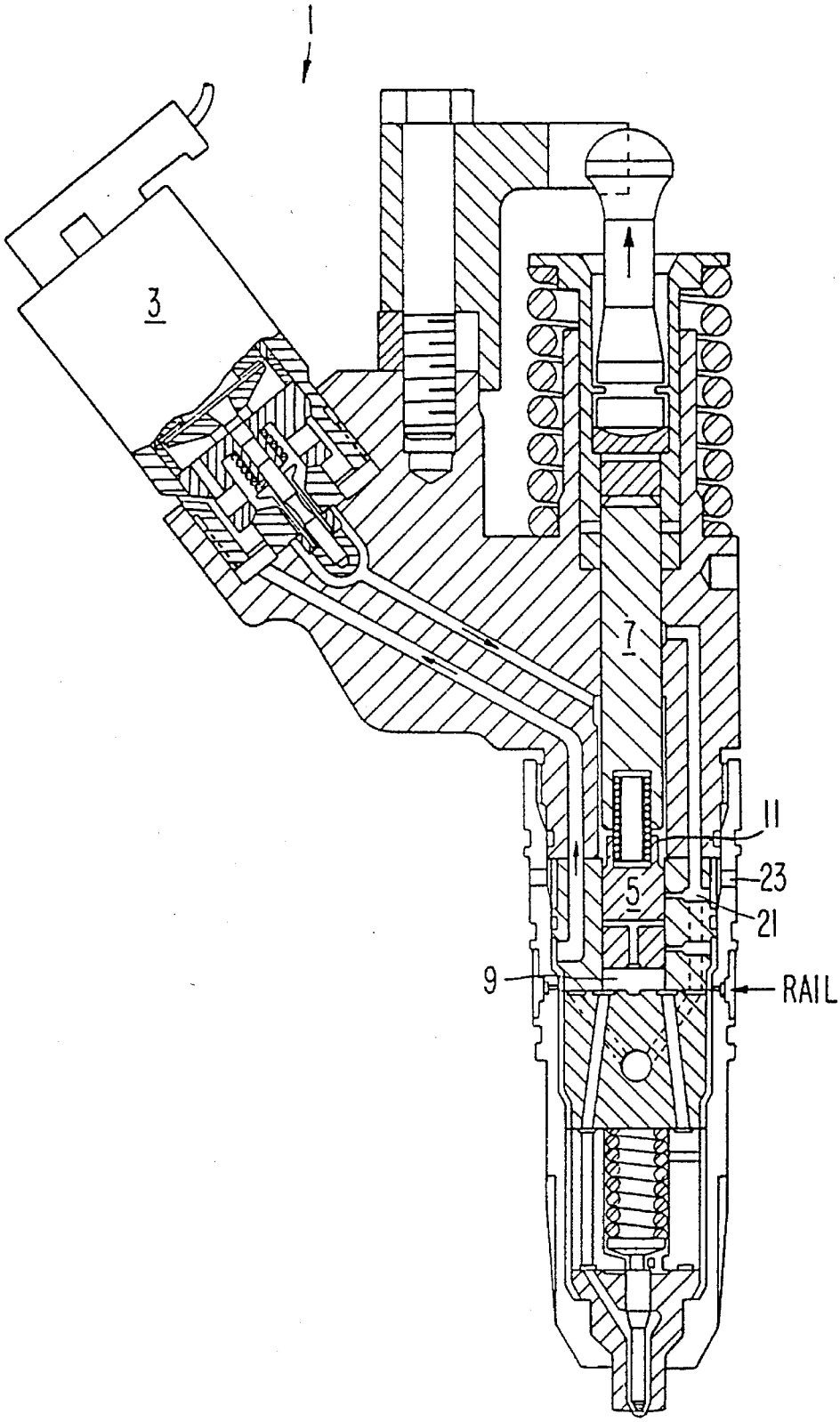
FIG. 2 (PRIOR ART)
FIG. 2 is schematic cross-sectional depiction of the FIG. 1 fuel injector during a timing chamber filling phase.
Figures 3, 3A:
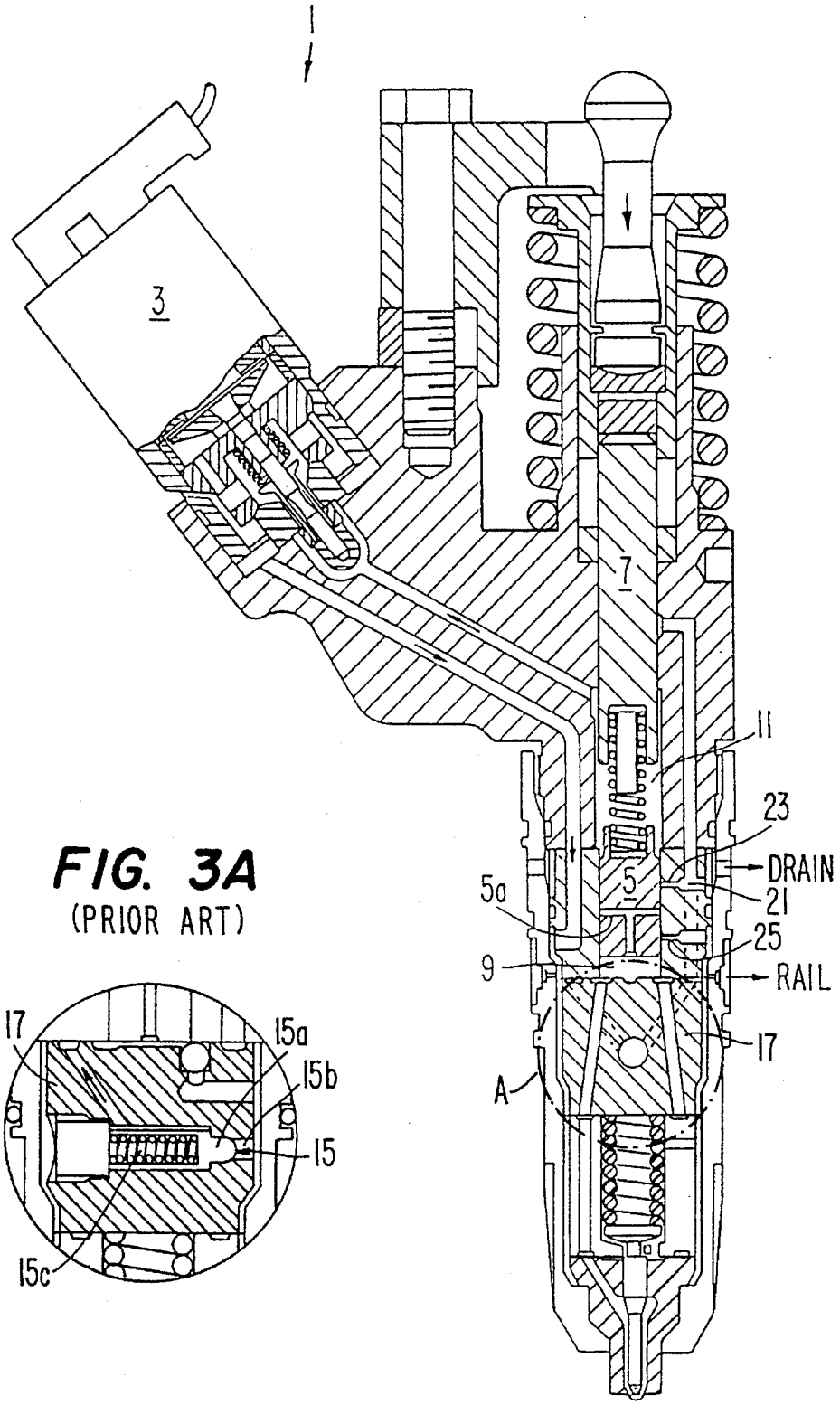
FIG. 3 (PRIOR ART)
FIG. 3A (PRIOR ART)
FIG. 3 is schematic cross-sectional depiction of the FIG. 1 fuel injector during a timing phase.
Figure 4:
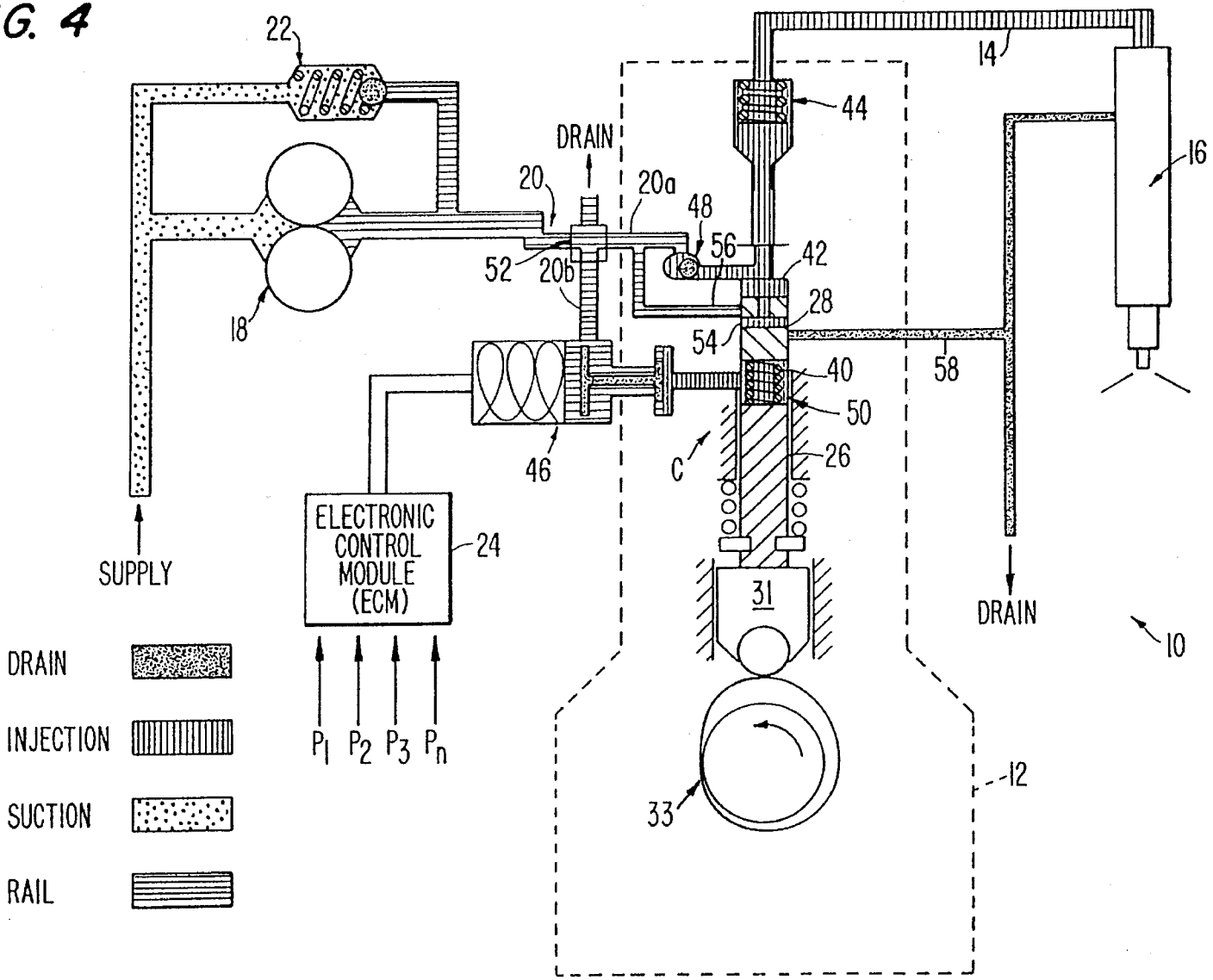
FIG. 4 is a schematic diagram of a pump-line-nozzle fuel injection system in accordance with the parent application.

With reference to FIG. 4, the pump-line-nozzle fuel injection system 10 in accordance with the parent application can be seen to be comprised of an inline high pressure pump 12 having a plurality of identical pumping cylinder units C (only one of which is shown), each of which is connected by a high pressure line 14 to a respective one of a plurality of engine fuel injectors 16 (only one of which is shown), and corresponding in number to the number of cylinders of the internal combustion engine with which it is to be used (not shown). A low pressure supply pump 18 draws fuel from a fuel supply (such as a vehicle fuel tank) and supplies the fuel to each of the pumping cylinder units C of inline pump 12, via a fuel supply circuit 20, at a pressure of, e.g., about 30 psi, which is held substantially constant by a pressure regulator 22.

Since the construction and operation of all of the pumping cylinder units C of inline pump 12 are identical, for simplicity, only the single pumping cylinder unit C shown will be described in detail, it being understood that such descriptions are not limited to only that one cylinder unit. On the other hand, it should be realized that each of the several pumping cylinder units of pump 12 is independently, individually controllable with respect to the timing and quantity of fuel caused to be injected thereby under the control of the Electronic Control Module (ECM) 24, as will be explained further below.

As illustrated, each pumping cylinder unit C comprises a timing plunger 26 and a metering plunger 28 that are reciprocatingly received in a bore of the pump 12. The timing plunger 26 is spring-loaded against a tappet 31 which rides on the periphery of a respective lobe of a pump cam shaft 33, pump cam shaft 33 being linked to the engine drive shaft to rotate in synchronism therewith. In view of the high pressures generated by the pumping unit C, e.g., approximately 15,000–18,500 psi, to at least partially compensate for the length of high pressure line 14 and the compressibility of the fuel therein, timing plunger 26 is, preferably, larger in diameter, about one-third larger, than the metering plunger 28 so as to achieve a fast pumping rate. For example, it has been found to be suitable to use a timing plunger of 12 mm diameter with a metering plunger of 9 mm.

A variable volume timing chamber 40 is defined in the bore of the pumping cylinder between the timing plunger 26 and a facing end of the metering plunger 28, and a metering chamber 42 is defined between the opposite end of the metering plunger and a delivery valve 44. The flow of timing fluid (which may be engine lubrication oil, or fuel as illustrated) into and out of the timing chamber is controlled by a solenoid valve 46, and return flow out of the metering chamber 42 is prevented by a metering check valve 48.

During the retraction stroke of timing plunger 26, initially, metering plunger 28 is drawn down with it and fuel flows into the metering chamber from a respective branch 20*a* of the fuel supply circuit 20. At the same time, solenoid valve 46 prevents timing fluid from flowing into timing chamber 40. When the ECM 24 determines that the appropriate quantity of fuel has been metered, it causes solenoid valve 46 to open. This starts the flow of timing fluid, in this case fuel via a timing fluid flow branch 20*b* of fuel supply circuit 20, into the timing chamber 40. This also has the effect of balancing the pressures at the opposite sides of the metering piston 28, so that it stops moving and floats relative to timing plunger which continues to move downward as it follows the cam 33. Furthermore, to insure that the metering plunger is held stationary and to prevent return flow leakage through the check valve 48, a spring 50 acts between the facing ends of the timing and metering plungers in order to prevent the metering plunger from drifting downward and to maintain enough pressure on the fuel in the metering chamber 42 to close the check valve 48. In this way, a precisely metered quantity of fuel to be injected is trapped in the metering chamber 42 once solenoid valve 46 opens and the timing chamber 40 fills with timing fluid (fuel).

As the tappet 31 continues to track the curvature of the lobe of cam 33, at the end of the retraction stroke, the timing plunger is caused to move in its compression stroke toward the metering piston and the discharge end of the pumping cylinder. However, until the ECM 24 determines that the appropriate time for commencement of injection has arrived, solenoid valve 46 remains open and the fuel is forced back out of the timing chamber 40, through the solenoid valve 46 to the supply circuit 20. To prevent this outflow of fuel from affecting the supply of fuel to travel to other pumping cylinder units via their supply branches 20*a*, a relief valve can be provided to vent high pressure spikes from the supply side of the system 10 to the drain side thereof, such a relief valve being schematically depicted by block 52 at the manifold junction from which the branches 20*a*, 20*b* extend; however, it will be appreciated that the relief valve 52 can be placed at any of a number of other locations instead.

Once the ECM 24 determines that the appropriate time for initiation of injection has arrived, it triggers closing of solenoid valve 46, thereby trapping the remainder of the fuel serving as the timing fluid in the timing chamber 40. This trapped fuel acts as a hydraulic link between the timing plunger 26 and the metering plunger 28, and thus, causing the upward force on the timing plunger 26 to be transferred to the metering plunger 28, pressurizing the fuel in the metering chamber 42. When the pressure of the fuel in the metering chamber 42 reaches the required level, e.g., 15,000–18,500 psi, the delivery valve 44 pops open, allowing the fuel to flow from the metering chamber 42 into the high pressure line 14 and into the injector 16. Because of the nozzle spray holes are closed by a needle valve of injector 16, continued upward movement of the plungers 26, 28, causes the pressure of the fuel to increase, and when the needle valve opening pressure is reached, the fuel causes the needle valve in the nozzle of injector 16 to open, so that the fuel exits spray holes of the nozzle into the combustion chamber of the engine. However, since the nozzle holes for a flow restriction, the fuel pressure will steadily increase as injection progresses and the plungers 26, 28 are driven further into the cylinder bore by the action of the tappet 31 and cam 33.

Injection is terminated when a T-shaped spill passage 54 in the metering piston 28 is brought into communication with a spill line 56, at which point the pressure in the metering chamber drops rapidly as the remaining fuel is spilled therefrom, thereby allowing the needle valve in injector 16 to close abruptly. The delivery valve 44 also closes and is designed to control line dynamics in high pressure line 14 so as to prevent secondary injection and insure a positive end to fuel injection. Immediately after the metering spill passage 54 reaches spill line 56, the end of the metering plunger 28, bounding the timing chamber 40, clears a drain port to drain line 58, spilling the timing fluid from the timing chamber 40 to drain as the timing plunger completes its inward movement, thus, completing the injection cycle.

The ECM can be of conventional design receiving various engine operating parameter inputs $P_1$, $P_2$ . . . $P_n$, such as engine speed, load, etc. and determining the appropriate times for opening and closing the solenoid valves 24 on the basis thereof and can also adjust for the compressibility of the fuel and the length of high pressure lines 14. Due to similarities between the embodiments of the parent case and the above-noted CELECT unit injector, they can share such components as the ECM, sensors and solenoid valve, and will enable service tools used with that unit injector for calibration and problem diagnosis to be used with the pump-line-nozzle system of parent case, thereby increasing its cost effectiveness, and it can be implemented on existing engines without redesign of the engine head or block. Likewise, no significant changes from the system and operation described above are needed to implement the mentioned ability to use lubrication oil as the timing fluid instead of fuel; that is, timing fluid line 50*b* and timing fluid drain line 58 need only be connected to the lubrication oil circuit instead of the fuel supply circuit as represent in FIG. 5 with the engine oil pump serving to supply lubrication oil to the timing chamber when the solenoid valve 46 opens.

Figure 6:
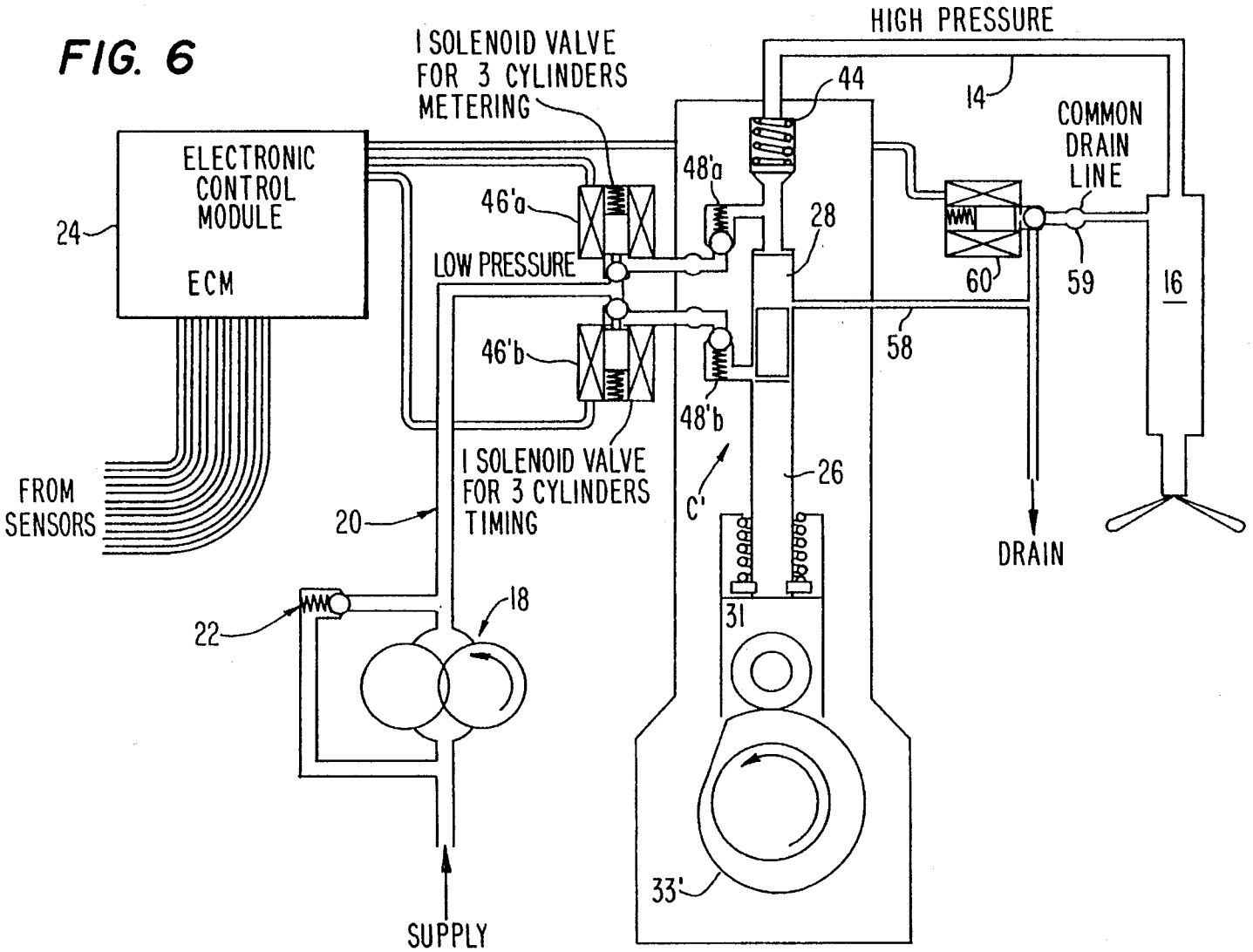
FIG. 6 is a schematic diagram of a pump-line-nozzle fuel injection system in accordance with the present application.
Figure 7:
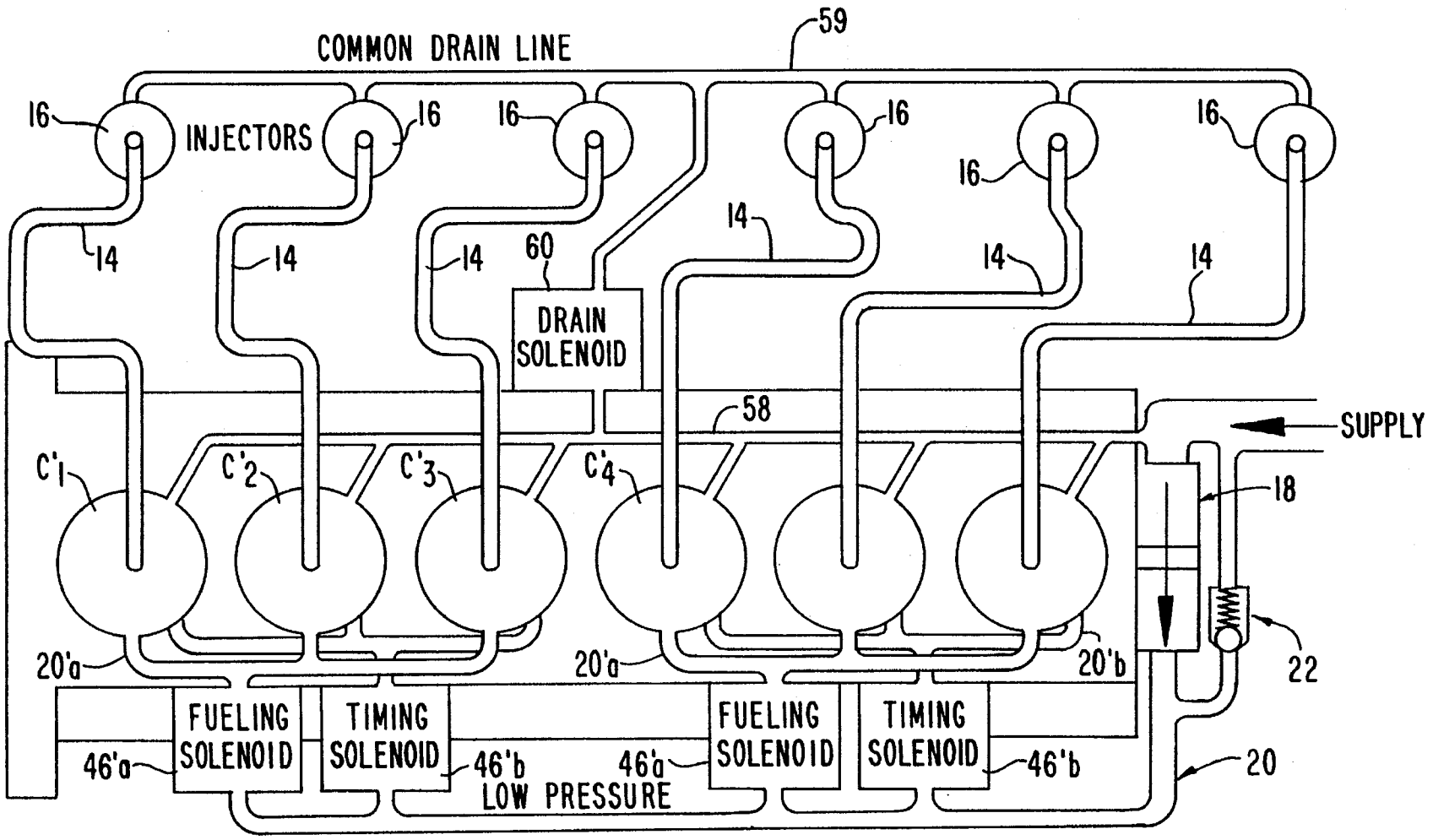
FIG. 7 is a schematic diagram of a pump-line-nozzle fuel injection system of FIG. 6 showing the grouping of plural pumping cylinders with respect to respective fueling and timing solenoid valves.

In this context, the nature and significance of the further developments incorporated into the preferred embodiment of a pump-line-nozzle fuel injection system 10' of the present application shown in FIGS. 6–8. In the following description, emphasis is placed on the points of distinction between system 10' and system 10 in accordance with the parent application, those attributes not being described being the same, a repeated description thereof having been omitted for the sake of brevity. Accordingly, those components which remain unchanged bear the same reference numerals while those which have been modified are distinguished by prime (') designations and new reference characters being applied to components having no counterpart.

As can be seen from FIGS. 6–8, pump-line-nozzle fuel injection system 10' is comprised of an inline high pressure pump 12' having a plurality of identical pumping cylinder units C', in the example shown in FIG. 7, pump 12' (for use with a six cylinder engine, not shown) has six cylinder units $C'_1$ to $C'_6$, which receive fuel from a low pressure pump 18 via a supply circuit 20 containing a pressure regulator 22, and which deliver fuel at high pressure via a high pressure line 14 to a respective fuel injector 16. As also represented, the cylinder units $C'_1$ to $C'_3$ and $C'_4$ to $C'_6$ are arranged to be grouped together so that flow to them from a common fueling branch 20'*a* and a common timing branch 20'*b* is controlled by a respective fueling solenoid 46'*a* and timing solenoid 46'*b* together with a check valve 48'*a*, 48'*b* for each cylinder. This is in contrast to the case, explained above, for the embodiments of the FIGS. 4 and 5, where each cylinder unit C has a solenoid 46 in flow path 20*b* to each timing chamber and a check valve 48 in the flow path 20*a* to each metering chamber. The arrangement of FIGS. 6–8, therefore, is advantageous in that only four solenoid valves are required instead of six (offering reductions in system size, weight and cost), and these solenoids need only act on low pressure fluid (less than 300 psi) and their response time requirements can be reduced (e.g., to 2 to 12 msec).

Figure 5:
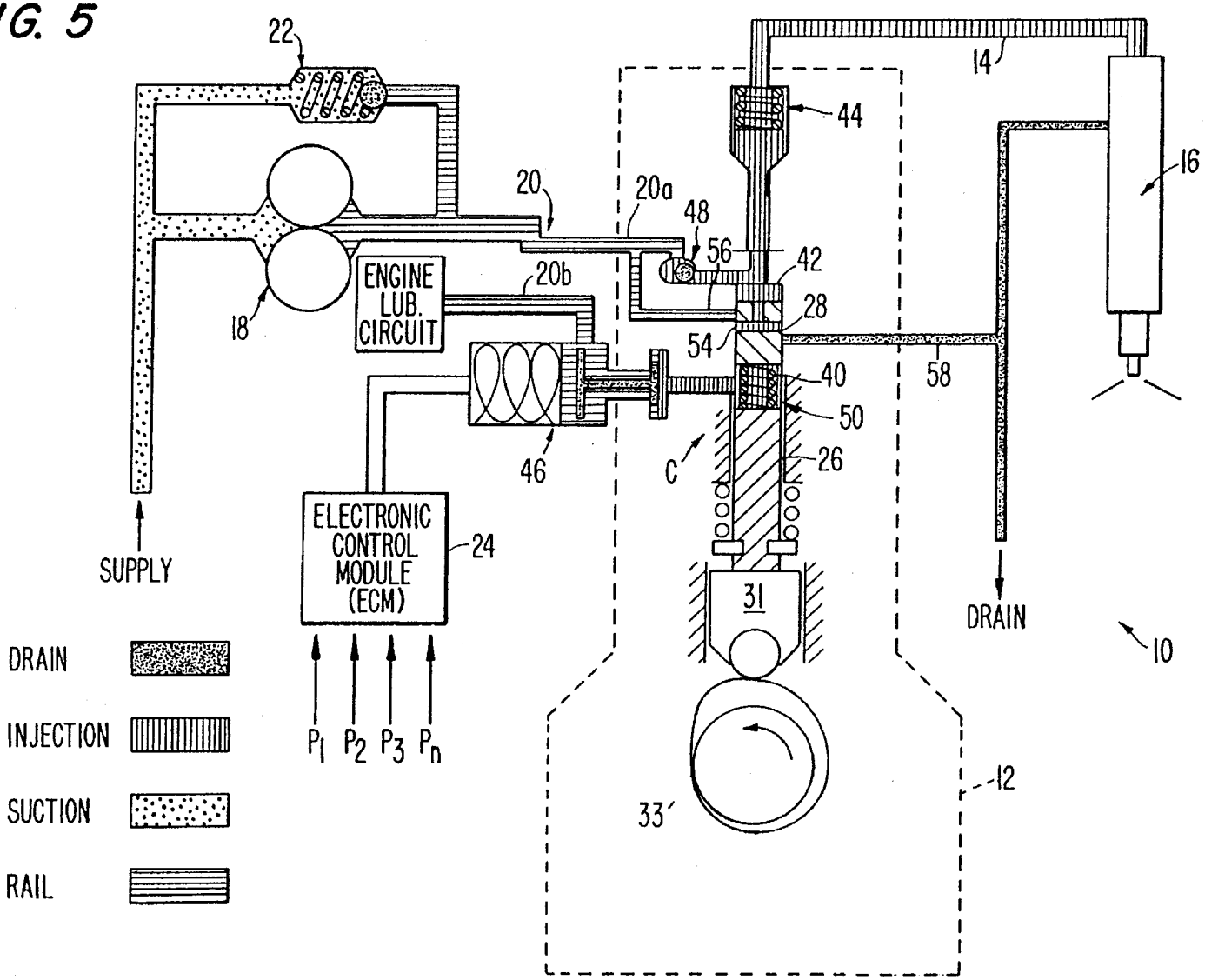
FIG. 5 is a schematic diagram as in FIG. 4, but of a modified embodiment of the parent application.

Furthermore, unlike the case of the embodiments of FIGS. 4 and 5, where the solenoid valve 46 controls both the quantity of fuel injected and the timing at which injection is initiated, thereby requiring high sensor accuracy and high solenoid valve responsiveness, the embodiment of FIGS. 6–8, utilizes the profile of camshaft 33' to determine when injection is initiated with the quantities of timing fluid and fuel metered being controlled by the separate solenoid valves 46*a*, 46*b* under the control of the electronic control module ECM. In particular, for each group of cylinder units $C'_1$ to $C'_3$ and $C'_4$ to $C'_6$, only cylinder unit C' is active for receiving fuel and time fluid at any given time.

Figure 8C:
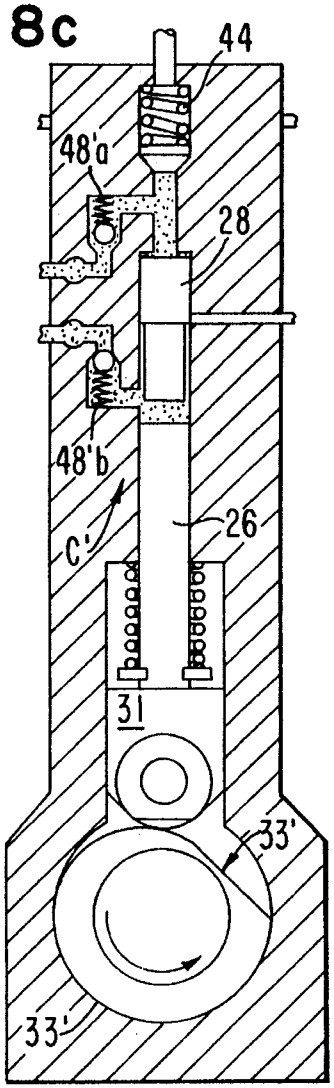
FIGS. 8*a*–8*c* are cross-sectional schematic views of a portion of the pump-line-nozzle fuel injection system of FIG. 6, showing the plunger positions and cam angles of the pumping cylinders of a first set of pumping cylinders at an engine crank angle of 0°, 120° and 240°, respectively.
Figure 8B:
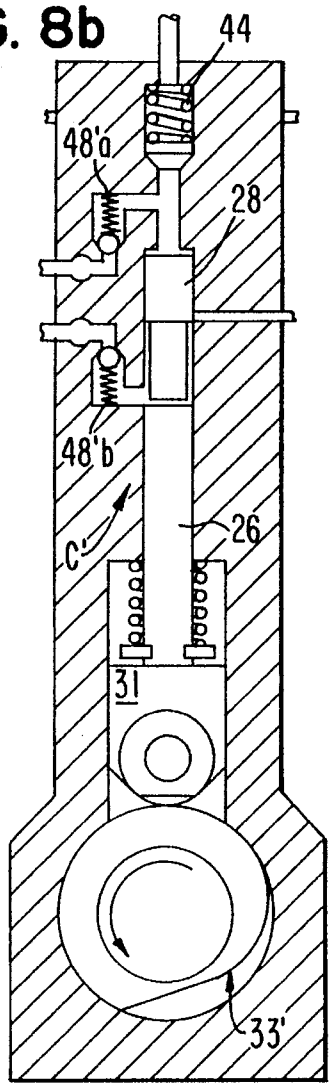
Figure 8A:
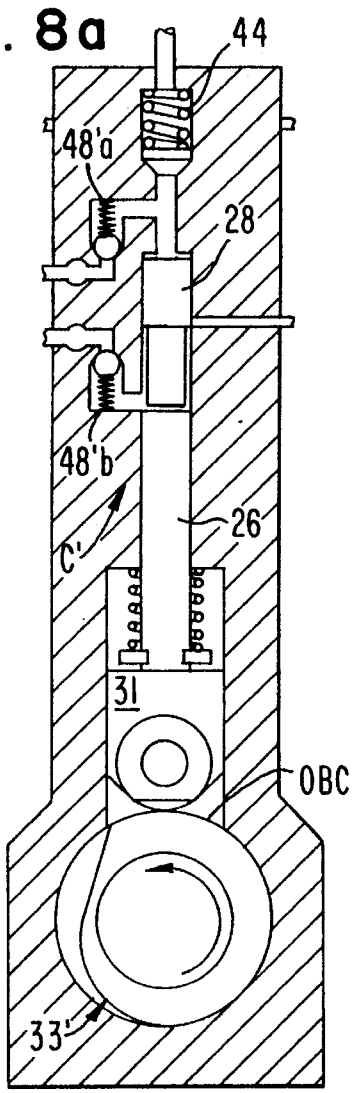

That is, as can be seen from FIGS. 8*a*–8*c* viewed together, as one pumping unit C', of a group of three pumping units, has completed its injection stroke (FIG. 8*a*), another one of the pumping units has commenced its metering phase (FIG. 8*c*). At the same time, the third pumping unit (FIG. 8*b*) remains in its fully extended, end-of-injection position, on the outer base circle of the cam surface of its cam 33'. Put another way, at any given time only one pumping cylinder C' of each pumping group is in a metering and injection phase, the others being held against downward movement. In this way, the single fueling solenoid valve 46'*a* and the single timing solenoid valve 46'*b* can control flow to metering and timing chambers of all pumping cylinders C' of the group with the cams 33' controlling the initiation of injection. During injection, the check valves 48'b, 48'a serve to prevent return flows from the timing and metering chambers 40, 42 back through the solenoid valves 46'b, 46'a. Opening and closing of the solenoid valves 46a, 46, is set by the ECM on the basis of various engine operating parameter inputs, such as engine speed, load, etc. as with the embodiment of FIGS. 4 and 5, with the amount of fuel/timing fluid metered being a function of the pressure in the supply circuit 20 and the amount of time that the respective solenoid valve 46a, 46b is open while the tappet 31 and plunger 26 are descending along the metering (inwardly descending) portion of the cam surface of cam 33'.

This construction and operation causes the fuel to be metered immediately before it is injected instead of over almost a full rotation of the cam, improving engine control and response time, especially at low engine speeds. Furthermore, the timing of the opening and closing of the solenoid valves relative to camshaft position becomes less critical since the valves only have to be open during the metering period; injection timing is controlled by the camshaft profile and metered quantity of fuel and not by when the solenoid is actuated (as in the embodiment of FIGS. 4 & 5). As a result, problems related to position sensor accuracy and gear train torsional effects are eliminated.

Additionally, with the above-described system, the possibility also exists to vary the injection pressure electronically. That is, a common drain line 59 is connected to all of the fuel injectors 16. A drain solenoid valve 60 is disposed in the common drain line 59 and forms a pressure control means for creating a backpressure in drain line 59 between injections, and in turn, this increases the initial pressure in the high pressure lines 14 by acting in a closing direction on a closing needle valve of the injectors 16 or on the delivery valve 44. It has been found that a higher initial pressure in the high pressure line 14 produces an increase in the injection pressure by approximately the same amount as the backpressure-induced increase.

While only a preferred embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

Industrial Applicability

The present invention will find a wide range of applicability for small and midrange engines, especially diesel engines, requiring full electronic fuel control to reduce emissions and improve fuel consumption. Furthermore, it will be particularly attractive to those who also make or use engines having unit injector type fuel injection systems due to the opportunities for increased cost effectiveness.

We claim:

1. A pump-line-nozzle fuel injection system comprising a high pressure inline fuel pump having a plurality of high pressure pumping cylinder units, each of which comprises a plunger assembly reciprocatingly mounted within a cylinder bore, and a low pressure fuel supply pump connected to each cylinder; wherein each plunger assembly comprises a timing plunger, a floating metering plunger, and a cam for driving said timing plunger, a variable volume timing chamber being defined in said cylinder bore between an end of the timing plunger and a first end of the metering plunger, and a variable volume metering chamber being defined in said cylinder bore between a second end of the metering plunger and a delivery valve at an outlet end of the respective cylinder; wherein said supply pump is connected to a group of said high pressure pumping cylinder units via a fueling solenoid valve means for controlling flow to the metering chamber of the high pressure pumping cylinder units of said group via a fuel supply branch of a fuel supply flow path from the supply pump containing a check valve between the fueling solenoid means and each metering chamber in a manner enabling a flow of fuel to enter said metering chamber during a retraction stroke of the plunger assembly; wherein said timing chamber is connected to a supply of timing fluid via a timing flow path containing a timing solenoid valve means for controlling flow to the timing chamber of the high pressure pumping cylinder units of said group via a second check valve located between the timing solenoid valve means and each timing chamber in a manner enabling a flow of timing fluid to enter said timing chamber during the retraction stroke of the plunger assembly; wherein electronic control means is provided for opening and closing said fueling and timing solenoid valve means for providing a required amount of fuel to said metering chamber and a required amount of timing fluid to said timing chamber during the retraction stroke of the plunger assembly of each of the pumping cylinder units of the group; wherein said delivery valve is responsive to the pressure of fuel in said metering chamber for enabling delivery of fuel to a respective fuel injector via a high pressure delivery line when the pressure of fuel in said metering chamber exceeds a predetermined value during a compression stroke of the plunger assembly; and wherein the cams for the high pressure pumping cylinder units of said group are configured relative to each other as a means for producing injection of fuel from each pumping cylinder by compression of fuel in said metering chamber and for producing the retraction stroke of each plunger assembly of the group while all of the other plunger assemblies of the group are in a maximally inwardly displaced, end of the compression stroke position.

2. A pump-line-nozzle fuel injection system according to claim 1, wherein said timing fluid flow path is a branch of said fuel supply flow path by which fuel is supplied to said timing chamber as said timing fluid.

3. A pump-line-nozzle fuel injection system according to claim 2, wherein a check valve is disposed between each metering chamber and the fueling solenoid with which it is grouped and a check valve is disposed between each timing chamber and the timing solenoid with which it is grouped, said check valves serving as a means for preventing return flow from said metering and timing chambers.

4. A pump-line-nozzle fuel injection system according to claim 3, wherein said timing plunger has a larger diameter than said metering plunger.

5. A pump-line-nozzle fuel injection system according to claim 4, wherein the diameter of the timing plunger is approximately one-third larger than the diameter of the metering plunger.

6. A pump-line-nozzle fuel injection system according to claim 1, wherein said timing plunger has a larger diameter than said metering plunger.

7. A pump-line-nozzle fuel injection system according to claim 6, wherein the diameter of the timing plunger is approximately one-third larger than the diameter of the metering plunger.

8. A pump-line-nozzle fuel injection system according to claim 1, wherein a common drain line is connected to all of the fuel injectors; and wherein a drain solenoid valve is disposed in said common drain line, said solenoid valve forming a pressure control means for creating a backpressure in said common drain line between injections and thereby increasing the initial pressure in said high pressure lines.

9. A pump-line-nozzle fuel injection system according to claim 8, wherein a check valve is disposed between each metering chamber and the fueling solenoid with which it is grouped and a check valve is disposed between each timing chamber and the timing solenoid with which it is grouped, said check valves serving as a means for preventing return flow from said metering and timing chambers.

10. A pump-line-nozzle fuel injection system according to claim 9, wherein said timing plunger has a larger diameter than said metering plunger.

11. A pump-line-nozzle fuel injection system according to claim 10, wherein the diameter of the timing plunger is approximately one-third larger than the diameter of the metering plunger.

12. A pump-line-nozzle fuel injection system according to claim 8, wherein a check valve is disposed between each metering chamber and the fueling solenoid with which it is grouped and a check valve is disposed between each timing chamber and the timing solenoid with which it is grouped, said check valves serving as a means for preventing return flow from said metering and timing chambers.

* * * * *